United States Patent [19]

Butler et al.

[11] Patent Number: 4,752,185

[45] Date of Patent: Jun. 21, 1988

[54] NON-CONTACTING FLOWPATH SEAL

[75] Inventors: Lawrence Butler; Gary C. Wollenweber, both of Cincinnati, Ohio; Thomas G. Wakeman, Lawrenceburg, Ind.

[73] Assignee: General Electric Company, Cincinnati, Ohio

[21] Appl. No.: 80,944

[22] Filed: Aug. 3, 1987

[51] Int. Cl.[4] ..... F04D 29/08

[52] U.S. Cl. ..... 415/175; 415/116

[58] Field of Search ..... 415/115, 116, 112, 175, 415/117, 176, 110; 277/3, 15, 16, 135

[56] References Cited

U.S. PATENT DOCUMENTS

| | | | |
|---|---|---|---|
| 2,685,429 | 8/1954 | Auyer | 415/110 |
| 2,963,268 | 12/1960 | Smile et al. | 415/110 |
| 3,092,393 | 6/1963 | Morley et al. | 277/16 |
| 3,393,024 | 7/1968 | Rhodes et al. | 415/112 |
| 3,597,102 | 8/1971 | Unsworth et al. | 415/112 |
| 3,975,901 | 8/1976 | Hallinger et al. | 415/117 |
| 3,980,411 | 9/1976 | Crow | 415/1 |
| 4,161,318 | 7/1979 | Stuart et al. | 277/53 |
| 4,317,646 | 3/1982 | Steel et al. | 415/117 |
| 4,439,982 | 4/1984 | Weiler et al. | 415/117 |

FOREIGN PATENT DOCUMENTS

| | | | |
|---|---|---|---|
| 14616 | 1/1956 | Fed. Rep. of Germany | 415/115 |

*Primary Examiner*—Robert E. Garrett
*Assistant Examiner*—John T. Kwon
*Attorney, Agent, or Firm*—Derek P. Lawrence; Nathan D. Herkamp

[57] ABSTRACT

A fluid seal arrangement for use in a turbomachine, having first and second adjacent sets of turbine blades arranged for relative rotation about a common machine axis. A main fluid flowpath is established across the blades. Parts of at least one set of blades form a clearance opening which communicates between the main fluid flowpath and an outside region. An annular arm projects over the clearance opening into the outside region to form with an outer periphery of the other set of blades an annular passage communicating with the clearance opening. An annular cavity on the other blades receives a buffer fluid. Jet openings from the cavity direct a pressurized supply of the buffer fluid into the annular passage, to induce a sealing fluid flow from the outside region through the clearance opening and into the main fluid flowpath to prevent leakage of fluid from the main fluid flowpath through the clearance opening.

25 Claims, 3 Drawing Sheets

NON-CONTACTING FLOWPATH SEAL

BACKGROUND OF THE INVENTION

1. Field of the Invention

The present invention relates generally to fluid seals used to prevent leakage of fluid from a defined flowpath out of clearance openings formed by parts of a turbomachine. In particular, the invention relates to a non-contacting ejector seal for use in a gas turbine engine.

2. Description of the Known Art

It has been common practice to employ so-called labyrinth seals in turbomachines to reduce leakage of working fluid out of a main flowpath defined by stator and rotor blades of the machine, through clearance openings formed by at least one of the blades, and into an outside region beyond the main flowpath. For example, it is sometimes necessary to extend the rotor blades radially outward beyond the main flowpath to form a discontinuity between the extended rotor blades and points at the outer peripheries of adjacent stator blades. A labyrinth seal is often used to span such a discontinuity to minimize fluid leakage outward from the flowpath. An example of such a seal arrangement is disclosed in U.S. Pat. No. 4,103,899, issued Aug. 1, 1978. Usage of labyrinth seals in other applications in turbomachines is also disclosed in U.S. Pat. Nos. 4,320,903 issued Mar. 23, 1981 and 3,527,053 issued Sept. 8, 1970.

Labyrinth seals have the disadvantage of a finite leakage rate which in some cases may be unacceptable for performance reasons, or because hot flowpath fluids create mechanical problems in the region outside the flowpath, such as high temperature problems or contamination. The leakage rate can be reduced by reduced seal clearance, but there is a minimum seal clearance as a function of seal history and current operating conditions. The minimum seal clearance exists due to out of roundness conditions, differential radial growths, and dynamic loading of the structure. Such mechanical problems may be alleviated in the outside region by buffering the seal with a high pressure fluid. Nonetheless, unacceptable leakage rates exist even with the known fluid buffered labyrinth seal arrangements.

SUMMARY OF THE INVENTION

An object of the invention is to overcome the above and other disadvantages of the known labyrinth seals in turbomachine applications.

Another object of the invention is to provide a non-contacting flowpath seal which substantially eliminates fluid leakage from a main flowpath in a turbomachine.

A further object of the invention is to provide a non-contacting flowpath seal which uses a buffer fluid obtained from an upstream stage and returns substantially all of the buffer fluid to the main flowpath.

Still a further object of the invention is to provide an ejector seal which eliminates fluid leakage and also sucks in air in the space about the engine to ventilate the engine without need of blowers.

A further object of the invention is to provide a non-contacting flowpath seal with seal clearances sufficient to prevent rubs and subsequent seal deteriorations under normal operating turbomachine applications.

According to the invention, a fluid seal arrangement is provided for use in a turbomachine. The turbomachine includes a first set of turbine blades and a second set of turbine blades adjacent the first set of turbine blades, the sets being arranged for relative rotation about a common machine axis. Boundary structures associated with the first and second sets of blades define the inner and outer circumferential boundaries between which a main fluid flowpath is established. Parts of at least one of the sets of blades form a clearance opening communicating between the fluid flowpath and an outside region beyond the circumferential boundaries in the radial direction. An annular arm projects from one blade over the clearance opening and onto the adjacent blade. The arm forming with an outer periphery of the adjacent blade an annular passage communicating with the clearance opening. An annular cavity is formed on said outer periphery of the adjacent blade which has a jet opening for directing a pressurized supply of buffer fluid from the cavity and out of the jet opening into the annular passage as a relatively high velocity buffer fluid jet. The high velocity jet interacts with fluid in the outside region beyond the circumferential boundary to induce a continuous sealing fluid flow from the outside region, through the clearance opening, and into the main fluid flowpath.

According to the invention there is also provided a method of preventing the working fluid in a turbomachine from escaping from the flowpath out of a clearance formed between relatively rotating parts of the turbomachine. The method includes the steps of ejecting at the clearance a supply of buffer fluid at a high velocity. A sealing fluid which surrounds the rotating parts is then sucked through the clearance and into the flowpath by means of the buffer fluid. In this manner, the inflowing sealing fluid blocks the escape of the working fluid from the flow path.

The various features of the novelty which characterize the invention are pointed out with particularity in the claims annexed and forming a part of the present disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
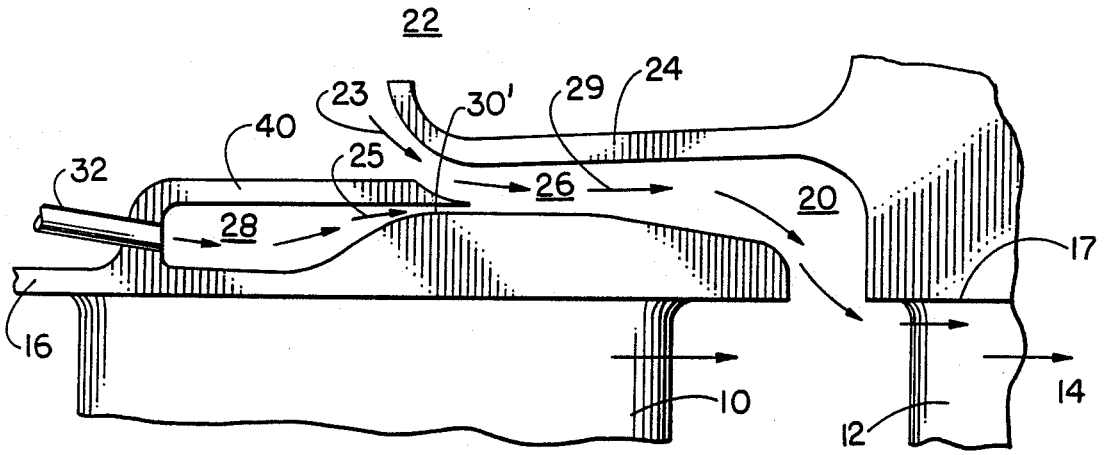
FIG. 1 is a partial view of stator and rotor blades in a turbomachine with a seal arrangement according to the invention.

FIG. 1 is a partial view of a stator blade 10 and a rotor blade 12 arranged adjacent one another along the axial direction of a turbomachine.

As known in the art, stator blade 10 is one of a number of like blades arranged to extend radially about the machine axis. Likewise, rotor blade 12 is one of a number of like blades arranged to extend radially of the machine axis. At least one set of turbine blades 10, 12 are arranged to be rotatable relative to the other about the common machine axis.

Figure 5:
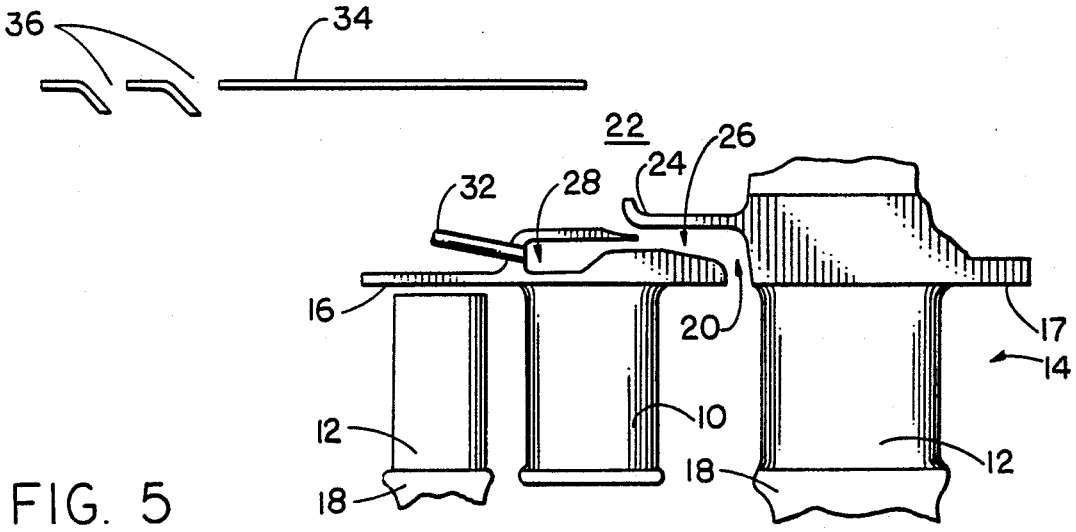
FIG. 5 is a partial view of a turbomachine as in FIG. 1 and having an enclosure modified according to the invention.

As shown in FIGS. 1 and 5, rotor blade 12 extends radially outward of a main fluid flowpath 14, which is established across the blades 10, 12. Outer shell 16 (FIGS. 1 & 5) associated with the stator blades 10, serves to define an outer circumferential boundary for the main fluid flowpath 14. Outer shell 17 (FIG. 1) associated with rotor blades 12 continue the definition of an outer circumferential boundary for the main fluid flowpath 14. Inner hub 18 (FIG. 5) serves to define an inner circumferential boundary for the main fluid flowpath 14.

In the illustrated embodiment, a clearance opening 20 occurs between the outer shell 16 and outer shell 17. The clearance opening 20 is necessary to allow the rotor blade 12 to extend radially outward of the contained flowpath 14, relative axial and circumferential displacement between shells 17 and 16, as well as rotation during normal turbomachine operation. As shown, clearance opening 20 communicates between the main fluid flowpath 14 and an outside region 22 radially beyond the outer circumferential boundary defined by shell 16 and 17. Unless effectively sealed, the clearance opening 20 will allow pressurized fluid to escape from the main fluid flowpath 14 to the outside region 22 with resultant loss in operating efficiency of the turbomachine, as well-understood by those skilled in the art.

According to the invention, an annular arm 24 projects over the clearance opening 20 in the outside region 22 of the main fluid flowpath 14. As shown in the figures, this occurs in the upstream direction. However, it could just as well be downstream for other applications. In the illustrated embodiment, the annular arm 24 projects from a part of the rotor blade 12 which extends radially outward of the outer circumferential boundary of the main fluid flowpath 14. The annular arm 24 forms with the outer periphery of the adjacent stator blade 10 an annular passage 26 which communicates with the clearance opening 20.

An annular cavity 28 having a jet or ejector opening 30 aligned generally in the axial direction is provided at the outer periphery of the stator blade 10. The jet opening 30 serves to direct a pressurized supply of buffer fluid into the annular passage 26 as a relatively high velocity buffer fluid jet. Accordingly, an interaction of the high velocity jet with fluid present in the outside region 22 near the annular projecting arm 24 induces a continuous sealing fluid flow 23 from the outside region 22 to mix with buffer fluid 25 in annular passage 26 and flow through the clearance opening 20 and into the main fluid flowpath 14. One or more supply pipes 32 communicate the buffer fluid to the annular cavity 28 from a turbomachine upstream stage at a total pressure significantly greater than the static pressures of outside region 22 or clearance opening 20. Such upstream stage can be, for example, a compressor stage of the machine or an upstream turbine stage. By such extraction, the buffer fluid has a high momentum after accelerating through jet opening 30. After mixing with sealing flow 23, the combined flow 29 is decelerated trading velocity for static pressure rise by means of diverging annular passage 26. Consequently, the embodiment will cause flow from outside region 22 at a low pressure to main fluid flowpath 14 at a relative higher static pressure. Similar embodiments are often described as a "jet pump" or "ejector pump" among those skilled in the art.

FIG. 5 shows an application of the present flowpath ejector seal in a gas turbine engine installed within an enclosure such as a nacelle 34 whereby an additional benefit is achieved. Air induced into an ejector system of which the blades 10, 12 are a part, is drawn from the space between the system and a wall of the nacelle 34. By providing vent openings 36 in the wall of the nacelle, the ejector causes air to be drawn into the outside region 22 around the turbine to allow continuous ventilation of the enclosed space by outside air. A mixed flow of the pressurized buffer fluid (e.g., compressor-supplied air) and the induced air passes through downstream turbine stages and the propulsion nozzle (not shown).

Figure 2:
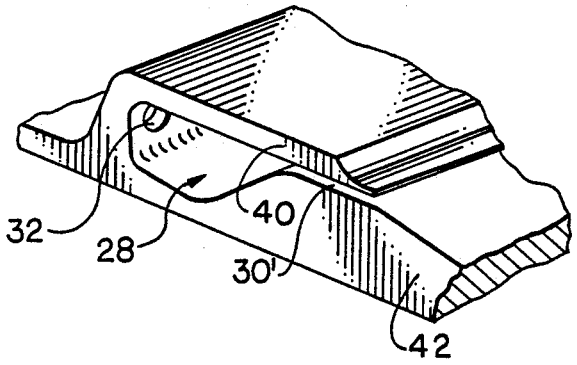
FIG. 2 is a perspective view of the ejector slits as shown in FIG. 1.

The jet openings 30, as shown in FIG. 1 can be of various forms. By way of example, as shown in FIG. 2, the ejector openings take the form of an annular slit 30'. The annular slit is formed as a narrow passageway between the upper roof portion 40 of the annular cavity 28 and the lower portion 42 which is the outer end of the adjacent stator blade. A continuously converging slit 30' is formed therebetween for accelerating and ejecting the buffer fluid at high velocity. The slit could also converge and then diverge for the purpose of greater buffer fluid velocity. The exit velocity of the buffer fluid at the slits can be at a velocity greater than the speed of sound at that point.

Figure 3:
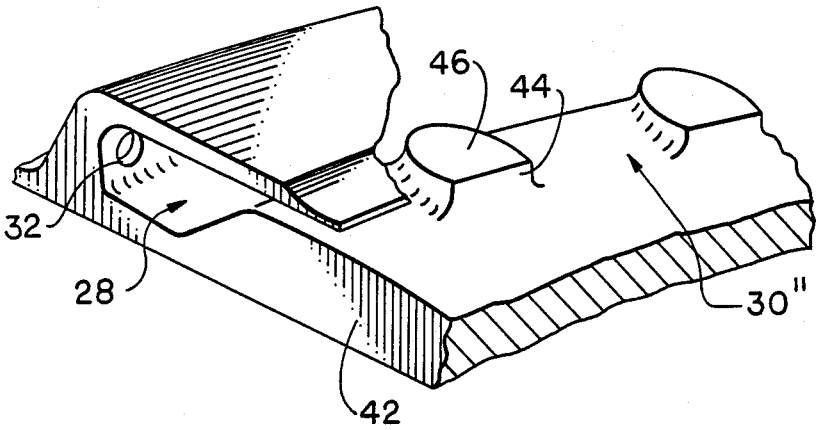
FIG. 3 is a perspective view of a first modification of a part of the seal arrangement according to the invention.

Other types of ejector slots can also be provided. By way of example, in FIG. 3, there are shown the ejector slots in the form of equally spaced apart circumferentially extending ejector slots 30''. These slots are formed between upstanding abutments 44 upwardly projecting from the outer wall 42'. The upstream portions of these abutments are rounded to provide a smooth accelerating flow of the ejected fluid therearound.

Figure 4:
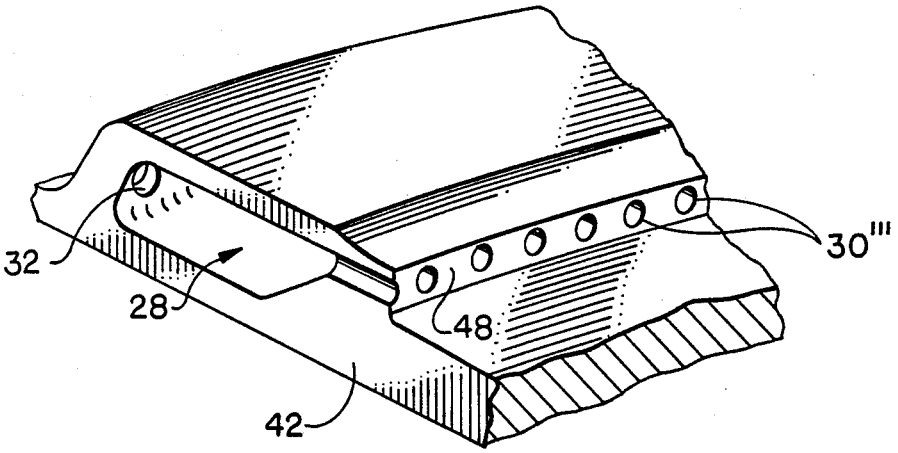
FIG. 4 is a perspective view of a second modification of a part of the seal arrangement according to the invention.

In FIG. 4, the ejector openings leaving from the annular cavity 28 are in the form of a number of equally circumferentially spaced holes 30''' . These holes are formed in a front solid wall 48 at the mouth of the annular cavity 28. It should be appreciated, however, that other types of ejector arrangements could also be provided.

Figure 6:
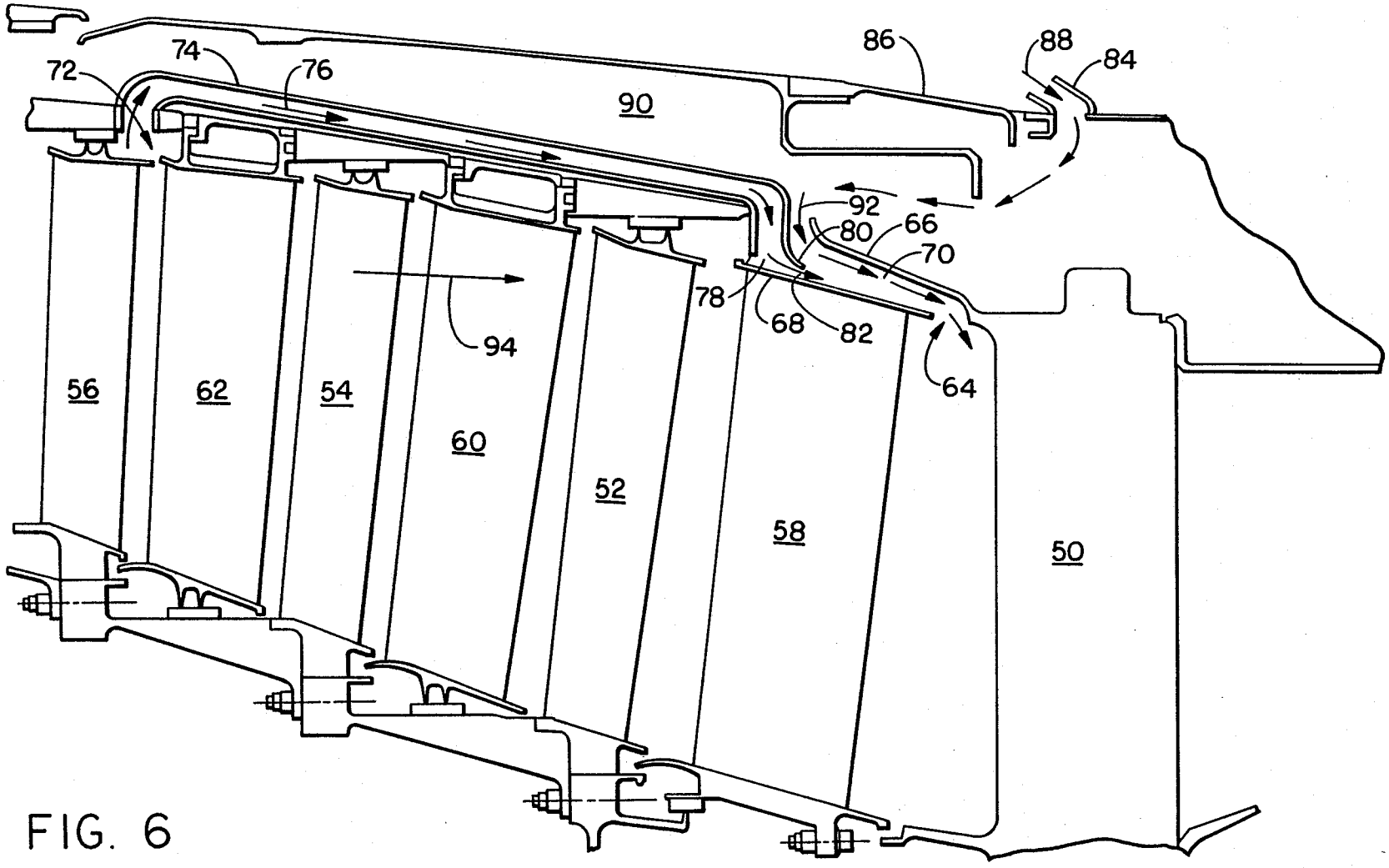
FIG. 6 is a partial view of the turbine portion of a jet engine incorporating the present invention.

Referring now to FIG. 6, there is shown a typical application of the ejector seal with respect to the turbine portion of a gas engine. In the particular arrangement shown, the turbine comprises a plurality of blades with alternating ones of the blades being counter-rotating to the intermediate adjacent blades. Specifically, the blades 50, 52, 54 and 56 would be rotating in one direction while the interspersed blades 58, 60 and 62 would be counter-rotating in the opposite direction. It should therefore be appreciated that the present ejector seal is useful not only between rotating and stationary parts, but even between counter-rotating parts as well. Between the rotating blades 50 and 58, there is a clearance gap 64 which is one exemplary embodiment measures approximately 0.38 inches wide in the axial direction. Extending upstream from the blade 50 is an annular arm 66 which projects over the radially outer periphery 68 of the adjacent blade 58 to define the annular passageway 70 therebetween. The radial height in the exemplary embodiment of the annular passage 70 is approximately 0.5 inches. The supply of buffer fluid is provided at an upstream location 72 of the gas turbine itself. At such upstream location, the fluid flow is at a higher pressure than at the location of the clearance 64. Such fluid flow is provided within a passageway 74 which directs the fluid in a form of a buffer fluid as shown by the arrows 76. The buffer fluid is provided into an annular cavity 78 formed between the radially outer periphery 68 of the blade 58 and an overhanging roof wall 80. The pressure of the buffer fluid in the annular cavity 78 is significantly greater than the pressure at clearance gap 64. This buffer fluid is accelerated by a converging annular passage 82 to a high velocity. A number of scoops 84 are provided within the outer nacelle wall 86 surrounding the gas turbine. The scoops permit the inflow of exterior air as shown by the arrows 88. The air will be sucked into the space 90 between the outer nacelle 86 and the turbine whereby it will serve as a ventilation within the space 90 to cool the outer periphery of the turbine stages. At the same time, this air will continue to flow into the annular passageway 92 formed between the extending arm 66 and the outer periphery 68 of the adjacent blade.

The inflow of the air through the passageway 92 will serve to counter any possible leakage of the fluid passing along the main fluid flowpath across the turbine blades as shown by the arrows 94.

It will therefore be seen, that the present invention operates as an ejector or jet pump which serves to seal the fluid flowing in the main flowpath and preventing any overboard leakage from such main flowpath. At the same time additional benefits are provided. As compared to a labyrinth seal, there is no system wear on the present type of seal arrangement. Furthermore, the clearance between the rotating and stationary members is less sensitive on the ejector and permits a larger clearance between the rotator parts than a labyrinth seal.

The present seal further provides improved efficiency because the buffer air is not lost from the cycle. At the same time, heat loss from the engine casing is returned into the cycle itself. Further benefits can be provided, as heretofore explained, where openings are available in the outer nacelle. Sucking in of the external air provides a ventilation benefit in the space around the engine automatically without the need of blowers or external systems. Furthermore, no ventilation exhaust duct is required since the ventilation air enters the main flow stream itself.

In specific applications, less high pressure buffer fluid is required to drive the ejector system than a conventional labyrinth seal.

It will be understood that the dimensions and proportional structural relations shown in the drawing figures are for exemplary purposes only, and that the figures do not necessarily represent actual dimensions or proportional structural relationships used in the flowpath seal of the invention.

Numerous modifications, variations, and equivalents can be undertaken without departing from the invention, which is delineated only by the scope of the appended claims.

We claim:

1. A fluid seal arrangement for a turbomachine having a main fluid flowpath extending axially along the turbomachine, first and second structural members of the turbomachine within the flowpath movable relative to each other and forming a clearance opening therebetween communicating between the flowpath and a region outside the flowpath, said fluid seal arrangement comprising:

an annular arm projecting from the first structural member and adjacent the second structural member to define an annular passage therebetween and communicating with said clearance opening;

an annular cavity on said second structural member for receiving a supply of buffer fluid; and ejector openings communicating between said annular cavity and said annular passage for directing a pressurized supply of the buffer fluid out of the annular cavity and into the annular passage to induce a flow of sealing fluid from the region outside the flowpath into said annular passage, through said clearance opening and into the main fluid flowpath, whereby fluid within the main flowpath is prevented from escaping from the main flowpath through said clearance opening.

2. A fluid seal arrangement as in claim 1, and further comprising supply means for communicating the buffer fluid to said annular cavity.

3. A fluid seal arrangement as in claim 2, wherein said supply means includes a stage of a turbomachine upstream of a stage in which said annular cavity is located and supply means for communicating a pressurized fluid from the upstream stage to said annular cavity.

4. A fluid seal arrangement according to claim 3, wherein the upstream stage is a compressor.

5. A fluid seal arrangement as in claim 3, wherein the annular cavity is at a stage in a turbine and the upstream stage is an upstream stage of the turbine.

6. A fluid seal arrangement as in claim 1, wherein said first and second structural members are first and second sets of turbine blades.

7. A fluid seal arrangement as in claim 6, wherein said first set of turbine blades forms a rotor and said second set of turbine blades forms a stator of the turbomachine, and said annular cavity is on the outer periphery of the stator.

8. A fluid seal arrangement as in claim 7, wherein said stator and said rotor together form said clearance opening, and said annular arm is on an outer periphery of the rotor.

9. A fluid seal arrangement as in claim 6, wherein said first and second sets of turbine blades are both rotor blades with each set counter-rotating from the other set.

10. A fluid seal arrangement as in claim 1, wherein said ejector openings are in the form of annular slits.

11. A fluid seal arrangement as in claim 1, wherein said ejector openings are in the form of a number of equally circumferentially spaced apart holes.

12. A fluid seal arrangement as in claim 1, wherein said ejector openings are in the form of a number of equally spaced, circumferentially extending slots.

13. A fluid seal arrangement as in claim 12, and comprising spacing blocks between adjacent slots, said spacing blocks having arcuate rear walls facing the flow of the pressurized buffer fluid.

14. A fluid seal arrangement as in claim 10, wherein said ejector openings form converging passages causing said buffer fluid to accelerate to a high velocity.

15. A fluid seal arrangement as in claim 10, wherein said ejector opening forms converging-diverging passages causing said buffer fluid leaving the slits to accelerate to a velocity greater than the speed of sound.

16. A fluid seal arrangement as in claim 1, wherein said annular passage has divergent walls to diffuse said flow causing simultaneous decrease in velocity and increase in static pressure.

17. A fluid seal arrangement as in claim 1, wherein the turbomachine further comprises an outer nacelle, openings in said nacelle for entry of air into the region outside the flowpath, said air forming the sealing fluid, whereby the flow of air from said nacelle openings and into the annular passage serves to ventilate the turbomachine.

18. A gas turbine arrangement within a turbomachine having a main fluid flowpath extending axially of the machine;

a first set of turbine blades arranged to extend radially about the machine axis;

a second set of turbine blades adjacent said first set of blades and arranged to extend radially about said machine axis, wherein said first and said second sets of blades are arranged to be rotatable relative to each other about said machine axis;

flowpath containing means associated with said first and said second sets of blades for defining an outer circumferential boundary and an inner circumferential boundary between which boundaries said main fluid flowpath is established, and defining a region outside of the flowpath;

wherein parts of at least one of said first and said second sets of blades form a clearance opening which communicates between said fluid flowpath and the outside region beyond one of said outer and said inner circumferential boundaries in the radial direction;

an annular arm projecting over said clearance opening and into said outside region;

said annular arm forming with an outer periphery of one of said first and said second sets of blades an annular passage communicating with said clearance opening;

means on said outer periphery forming an annular cavity having a jet opening aligned generally in the axial direction for directing a pressurized supply of buffer fluid out of said jet opening and into said annular passage as a relatively high velocity buffer fluid jet, to induce a continuous sealing fluid flow from the outside regions through said clearance opening and into said main fluid flowpath; and supply means for communicating the buffer fluid to said annular cavity;

wherein fluid within said main flowpath is prevented from escaping to said outside regions through said clearance opening by said sealing fluid flow.

19. A gas turbine arrangement as in claim 1, wherein the turbomachine comprises an outer nacelle, opening in said outer nacelle for entry into the region outside the boundaries, said air forming the sealing fluid, whereby the flow of air from said nacelle openings and into the annular passage also serves to ventilate the turbomachine.

20. A gas turbine arrangement as in claim 18, wherein said first set of turbine blades forms a rotor and said second set of blades forms a stator of the turbomachine, and said annular cavity is on the outer periphery of the stator.

21. A gas turbine arrangement as in claim 18, wherein said first and second sets of turbine blades form rotor blades with each set of rotator blades counter rotating from the other set of rotor blades.

22. A method of preventing a turbomachine working fluid flowing through a flowpath from escaping from the flowpath out of a clearance formed between relatively rotating parts of the turbomachine, comprising:

ejecting at the clearance a supply of buffer fluid at a high velocity; and conveying through the clearance and into the flowpath a sealing fluid sucked in from the area around the rotating parts by means of the buffer fluid, whereby the inflowing sealing fluid blocks the escape of the working fluid.

23. A method as in claim 22, further comprising the step of restricting the passageway through which the buffer fluid flows to provide the high velocity of the buffer fluid.

24. A method as in claim 22, wherein the rotating parts are enclosed within an outer shroud, and further comprising the step of providing openings in the shroud such that the sealing fluid is drawn in from outside the shroud, whereby the sealing fluid also serves to cool the rotating parts.

25. A method as in claim 22, wherein the sealing fluid, the buffer fluid, and the working fluid all flow in a single axial direction.

* * * * *